United States Patent [19]

Maruyama et al.

[11] Patent Number: 4,473,812

[45] Date of Patent: Sep. 25, 1984

[54] VOLTAGE-DEPENDENT NONLINEAR RESISTOR

[75] Inventors: Satoshi Maruyama; Koichi Tsuda; Kazuo Mukae; Ikuo Nagasawa, all of Kanagawa, Japan

[73] Assignees: Fuji Electric Co., Ltd.; Fuji Electric Corporate Research & Development, both of Kanagawa, Japan

[21] Appl. No.: 509,508

[22] Filed: Jun. 30, 1983

[30] Foreign Application Priority Data

Nov. 4, 1982 [JP] Japan ..... 57-193725
Nov. 4, 1982 [JP] Japan ..... 57-193726
Nov. 4, 1982 [JP] Japan ..... 57-193727

[51] Int. Cl.[3] ..... H01B 1/06

[52] U.S. Cl. ..... 338/21; 338/20; 252/521; 252/518; 252/519

[58] Field of Search ..... 338/20, 21; 252/518–521

[56] References Cited

U.S. PATENT DOCUMENTS 4,038,217 7/1977 Namba et al. ..... 252/521
4,045,374 7/1977 Nagasawa et al. ..... 252/521 X
4,069,061 1/1978 Nagasawa et al. ..... 252/521 X
4,091,144 5/1978 Dresner et al. ..... 338/308 X
4,160,748 7/1979 Yodogawa et al. ..... 252/521 X
4,169,071 9/1979 Eda et al. ..... 252/518 X
4,285,839 8/1981 Wong ..... 252/521 X
4,326,187 4/1982 Miyoshi et al. ..... 252/518
4,383,237 5/1983 Eda et al. ..... 338/21
4,386,022 5/1983 Nagasawa et al. ..... 338/20 X
4,397,775 7/1983 Levinson ..... 252/521 X
4,436,650 3/1984 Bowen ..... 338/21 X

*Primary Examiner*—C. L. Albritton
*Assistant Examiner*—Christopher N. Sears
*Attorney, Agent, or Firm*—Sughrue, Mion, Zinn, Macpeak and Seas

[57] ABSTRACT

A voltage-dependent nonlinear resistor containing ZnO as a main component and six auxiliary components, i.e., (1) a rare earth element; (2) Co; (3) at least one of Mg and Ca; (4) at least one of K, Rb and Cs, (5) as well as Cr; and (6) B which may be combined with at least one of Al, Ga and In. Alternatively, the auxiliary components may be (1) a rare earth element; (2) Co; (3) at least one of K, Rb and Cs; (4) Cr; (5) B; and (6) at least one of Al, Ga and In. The voltage-dependent nonlinear resistor of the present invention has high resistance to both long and short wave-tail surge currents and has an extended service life without sacrificing good nonlinearity.

7 Claims, No Drawings

VOLTAGE-DEPENDENT NONLINEAR RESISTOR

FIELD OF THE INVENTION

The present invention relates to a voltage-dependent nonlinear resistor, and more particularly, to a voltage-dependent nonlinear resistor that contains zinc oxide (ZnO) as a primary component and which is used as an overvoltage protective device.

BACKGROUND OF THE INVENTION

Varistors that contain silicon carbide (SiC), selenium (Se), silicon (Si) or zinc oxide (ZnO) as a primary component are used to protect electronic and electrical apparatuses against overvoltage. Those which conain zinc oxide as a primary component have low voltage limits and large voltage-dependent nonlinearity indices. Thus, they are used more often in protecting apparatuses that are composed of a semiconductor and other devices that have small resistance to overcurrent than those made of silicon carbide.

Voltage-dependent nonlinear resistors fabricated by sintering a mix that contains zinc oxide as a primary component and five auxiliary components in elemental or compound form, i.e., a rare earth element; cobalt (Co); at least one of magnesium (Mg) and calcium (Ca); at least one of potassium (K), rubidium (Rb) and cesium (Cs); and chromium (Cr), are known to have good voltage-dependent linearity. However, these types of resistors are not suitable for incorporation in small devices because they have a relatively small resistance to both long and short wave-tail surges and a short service life.

Resistors having good voltage-dependent nonlinear characteristics can also be fabricated by sintering a mix that contains zinc oxide as a primary component and auxiliary components in elemental or compound form, i.e., a rare earth element; cobalt (Co); at least one of potassium (K), rubidium (Rb) and cesium (Cs); and chromium (Cr). However, these resistors are also not suitable for incorporation in compact devices because they also have a relatively small resistance to long wave-tail surges and a short service life.

SUMMARY OF THE INVENTION

Therefore, one object of the present invention is to provide a voltage-dependent nonlinear resistor that is small in size and which has improved resistance to both long and short wave-tail surges as well as an extended service life.

In the course of research, it has been found that when a large amount of long or short wave-tail surge current is applied to a conventional voltage-dependent nonlinear resistor that contains ZnO as a main component and five auxiliary components, i.e., a rare earth element; Co; at least one of Mg and Ca; at least one of K, Cs and Rb; and Cr, current concentrations due to the concentrated electric field around the electrodes on the surface of the device causes a breakdown. It has also been found that when a D.C. current is impressed on the device a localized heterogeneity within the resistor becomes the center of current concentration and impairs the characteristics of the device.

The same phenomena were found to occur when a large amount of long wave-tail surge current was applied to another conventional type of voltage-dependent nonlinear resistor that contained ZnO as a main component and four auxiliary components, i.e., a rare earth element; Co; at least one of K, Ca and Rb; and Cr.

The mechanism behind this phenomena was also the same as above.

As a result of various studies made to solve these problems, it was discovered that by using as an additional auxiliary component, boron (B) which may be combined with at least one substance selected from among aluminum (Al), gallium (Ga), and indium (In), the peripheral area of the voltage-dependent nonlinear resistor became slightly more resistant than the central part and that this was effective in preventing current concentration from occurring in the area around the electrodes, thereby increasing the resistance to both long and short wave-tail surges. At the same time, the undesired heterogeneity disappeared from the inside of the resistor and its service life was appreciably extended.

Therefore, the present invention provides a voltage-dependent nonlinear resistor that contains ZnO as a main component and six auxiliary components, i.e., (1) a rare earth element, (2) Co, (3) at least one of Mg and Ca, (4) at least one of K, Rb and Cs, (5) Cr and (6) B which may be combined with at least one of Al, Ga and In.

The present invention also provides a voltage-dependent nonlinear resistor that contains ZnO as a main component and six auxiliary components, i.e., (1) a rare earth element, (2) Co, (3) at least one of K, Rb and Cs, (4) Cr, (5) B, and (6) at least one of Al, Ga and In.

DETAILED DESCRIPTION OF THE INVENTION

Either type of the voltage-dependent nonlinear resistors of the present invention can be produced by sintering a mix of ZnO and the necessary additives in metallic or compound form in an oxygen-containing atmosphere. The additives are usually employed in the form of metal oxides. However, those compounds which may become oxides during the subsequent sintering step, such as carbonate salts, hydroxides, fluorides and solutions thereof, may be used. The additives may also be used in elemental form if they are converted into oxides during the sintering step. In a particularly preferred embodiment, the voltage-dependent nonlinear resistor of the present invention is produced by intimately mixing ZnO powder with the necessary additives in either metallic or compound form, firing the mix at a temperature between 500° and 1000° C. for several hours, grinding the fired product into adequately small particles compacting the particles into the desired shape, and sintering the compacted particles in air at a temperature between 1100° and 1400° C. for several hours. If the sintering temperature is less than 1100° C., sufficient sintering to produce stable characteristics is not achieved. If the sintering temperature is more than 1400° C., a homogeneous product suitable for practical use is difficult to obtain and the only product that can be produced has a low degree of voltage-dependent nonlinearity. Further, with this product the properly controlled characteristics cannot always be obtained.

The present invention is described by the following examples to which the scope of the invention is by no means limited.

EXAMPLE 1

Samples of ZnO powder were mixed thoroughly with $Pr_6O_{11}$, $Co_3O_4$, MgO, $K_2CO_3$, $Cr_2O_3$, $B_2O_3$ and $Al_2O_3$ powders in the atomic percents prescribed in Table 1 below. Each mix was fired for several hours at between 500° and 1000° C. and ground into adequately small particles. After adding a binder, the particles were shaped into a disk having a diameter of 17 mm and sintered in air for 1 hour at between 1100° and 1400° C. Forty sintered disks were prepared in this manner. All 40 sintered disks were polished to a thickness of 2 mm and provided with an electrode on each side. Four electrical characteristic parameters were measured; i.e., (1) the interelectrode voltage $V_1$ mA that developed when a current of 1 mA was applied to the device at 25° C.; (2) the nonlinearity index $\alpha$ at 1-10 mA; (3) the resistance to long wave-tail surge current as measured in terms of the change in $V_1$ mA following 20 applications of a square-wave current of 100 A for 2 milliseconds; and (4) the service life as measured in terms of the change in interelectrode voltage $V_1$ $\mu$A at 1 $\mu$A following the application of 20 mA D.C. for 5 minutes.

The nonlinearity index $\alpha$ was calculated by the following approximation:

$$I=(V/C)^{\alpha}$$

wherein I is the current through the device at voltage V; and C is the voltage across the device per unit thickness at a current density of 1 mA/cm$^2$. The results are shown in Table 1. The atomic percents indicated in Table 1 were calculated from the ratio of the number of atoms of a specific additive element to the sum of the number of atoms of the metallic elements present in each mix.

TABLE 1

| Sample No. | Additives (atm %) Pr | Co | Mg | K | Cr | B | Al | $V_1$mA (V) | Non-linearity Index $\alpha$ | Resistance to long wave-tail surge $\Delta V_1$mA (%) | Service life $\Delta V_1\mu$A (%) |
|---|---|---|---|---|---|---|---|---|---|---|---|
| 1 | 0.10 | 5.0 | 0.1 | 0.1 | 0.1 | 0 | 0 | 384 | 41 | −75.4 | −20.1 |
| 2 | 0.01 | 5.0 | 0.1 | 0.1 | 0.1 | 0.01 | 0.005 | 213 | 37 | −86.2 | −35.1 |
| 3 | 0.08 | 5.0 | 0.1 | 0.1 | 0.1 | 0.01 | 0.005 | 225 | 35 | −8.3 | −3.8 |
| 4 | 0.1 | 5.0 | 0.1 | 0.1 | 0.1 | 0.01 | 0.005 | 245 | 38 | −2.4 | −4.2 |
| 5 | 1.0 | 5.0 | 0.1 | 0.1 | 0.1 | 0.01 | 0.005 | 258 | 43 | −1.9 | −9.2 |
| 6 | 5.0 | 5.0 | 0.1 | 0.1 | 0.1 | 0.01 | 0.005 | 294 | 41 | −28.8 | −19.6 |
| 7 | 7.0 | 5.0 | 0.1 | 0.1 | 0.1 | 0.01 | 0.005 | 303 | 40 | −63.1 | −25.2 |
| 8 | 0.1 | 0.05 | 0.1 | 0.1 | 0.1 | 0.01 | 0.005 | 183 | 34 | −69.7 | −37.1 |
| 9 | 0.1 | 0.1 | 0.1 | 0.1 | 0.1 | 0.01 | 0.005 | 191 | 35 | −36.3 | −18.5 |
| 10 | 0.1 | 0.5 | 0.1 | 0.1 | 0.1 | 0.01 | 0.005 | 205 | 33 | −12.4 | −7.2 |
| 11 | 0.1 | 1.0 | 0.1 | 0.1 | 0.1 | 0.01 | 0.005 | 227 | 31 | −3.1 | −2.1 |
| 12 | 0.1 | 10.0 | 0.1 | 0.1 | 0.1 | 0.01 | 0.005 | 283 | 38 | −13.5 | −10.2 |
| 13 | 0.1 | 15.0 | 0.1 | 0.1 | 0.1 | 0.01 | 0.005 | 312 | 37 | −80.3 | −19.3 |
| 14 | 0.1 | 5.0 | 0.005 | 0.1 | 0.1 | 0.01 | 0.005 | 214 | 31 | −86.2 | −27.8 |
| 15 | 0.1 | 5.0 | 0.01 | 0.1 | 0.1 | 0.01 | 0.005 | 221 | 29 | −10.1 | −13.5 |
| 16 | 0.1 | 5.0 | 1.0 | 0.1 | 0.1 | 0.01 | 0.005 | 273 | 38 | −7.4 | −9.2 |
| 17 | 0.1 | 5.0 | 5.0 | 0.1 | 0.1 | 0.01 | 0.005 | 281 | 41 | −8.9 | −15.1 |
| 18 | 0.1 | 5.0 | 7.0 | 0.1 | 0.1 | 0.01 | 0.005 | 292 | 42 | −45.1 | −25.3 |
| 19 | 0.1 | 5.0 | 0.1 | 0.005 | 0.1 | 0.01 | 0.005 | 224 | 33 | −79.6 | −30.3 |
| 20 | 0.1 | 5.0 | 0.1 | 0.01 | 0.1 | 0.01 | 0.005 | 231 | 35 | −2.3 | −8.4 |
| 21 | 0.1 | 5.0 | 0.1 | 0.5 | 0.1 | 0.01 | 0.005 | 258 | 35 | −1.5 | −9.3 |
| 22 | 0.1 | 5.0 | 0.1 | 1.0 | 0.1 | 0.01 | 0.005 | 292 | 37 | −19.4 | −18.3 |
| 23 | 0.1 | 5.0 | 0.1 | 2.0 | 0.1 | 0.01 | 0.005 | 331 | 40 | −37.2 | −28.2 |
| 24 | 0.1 | 5.0 | 0.1 | 0.1 | 0.005 | 0.01 | 0.005 | 225 | 37 | −78.1 | −19.6 |
| 25 | 0.1 | 5.0 | 0.1 | 0.1 | 0.01 | 0.01 | 0.005 | 232 | 35 | −5.3 | −2.5 |
| 26 | 0.1 | 5.0 | 0.1 | 0.1 | 0.5 | 0.01 | 0.005 | 259 | 35 | −13.7 | −3.4 |
| 27 | 0.1 | 5.0 | 0.1 | 0.1 | 1.0 | 0.01 | 0.005 | 273 | 38 | −28.5 | −10.2 |
| 28 | 0.1 | 5.0 | 0.1 | 0.1 | 2.0 | 0.01 | 0.005 | 307 | 37 | −80.4 | −15.1 |
| 29 | 0.1 | 5.0 | 0.1 | 0.1 | 0.1 | 0.0001 | 0.005 | 371 | 37 | −79.2 | −27.1 |
| 30 | 0.1 | 5.0 | 0.1 | 0.1 | 0.1 | 0.0005 | 0.005 | 352 | 38 | −20.3 | −10.4 |
| 31 | 0.1 | 5.0 | 0.1 | 0.1 | 0.1 | 0.005 | 0.005 | 257 | 30 | −2.3 | −6.2 |
| 32 | 0.1 | 5.0 | 0.1 | 0.1 | 0.1 | 0.05 | 0.005 | 187 | 28 | −1.5 | −5.3 |
| 33 | 0.1 | 5.0 | 0.1 | 0.1 | 0.1 | 0.1 | 0.005 | 147 | 24 | −7.6 | −8.1 |
| 34 | 0.1 | 5.0 | 0.1 | 0.1 | 0.1 | 0.5 | 0.005 | 112 | 7 | −8.3 | −12.3 |
| 35 | 0.1 | 5.0 | 0.1 | 0.1 | 0.1 | 0.01 | 0.00001 | 272 | 37 | −86.1 | −18.4 |
| 36 | 0.1 | 5.0 | 0.1 | 0.1 | 0.1 | 0.01 | 0.0001 | 275 | 42 | −67.2 | −17.1 |
| 37 | 0.1 | 5.0 | 0.1 | 0.1 | 0.1 | 0.01 | 0.001 | 257 | 45 | −5.1 | −10.2 |
| 38 | 0.1 | 5.0 | 0.1 | 0.1 | 0.1 | 0.01 | 0.01 | 231 | 41 | −1.7 | −5.4 |
| 39 | 0.1 | 5.0 | 0.1 | 0.1 | 0.1 | 0.01 | 0.05 | −198 | 29 | −10.5 | −4.2 |
| 40 | 0.1 | 5.0 | 0.1 | 0.1 | 0.1 | 0.01 | 0.1 | 114 | 9 | −16.2 | −19.4 |

As Table 1 shows, Sample No. 1 which corresponds to a conventional sintered product containing only ZnO, Pr, Co, Mg, K and Cr had a resistance to long wave-tail surge current of −75.4%, a service life of −20.1% and a nonlinearity index $\alpha$ of 41. Those products having a greater resistance to long wave-tail surge current and a longer service life were Sample Nos. 3 to 6, 9 to 12, 15 to 17, 20 to 22, 25 to 27, 30 to 34 and 36 to 40. Sample Nos. 34 and 40 had low nonlinearity indices and were not suitable for practical applications.

It is therefore concluded that to achieve the intended object of the present invention, Pr, Co, Mg, K, Cr, B and Al must be added in 0.08 to 5.0 atm %, 0.1 to 10 atm %, 0.01 to 5.0 atm %, 0.01 to 1.0 atm, %, 0.01 to 1.0 atm %, $5\times-10^4$ to $1\times10^{-1}$ atm %, and $1\times10^{-4}$ to $5\times10^{-2}$ atm %, respectively.

As is clear from Table 1, the resistance to long wave-tail surge current and service life of the systems containing Pr, Co, Mg and K as auxiliary components were greatly improved by incorporating B and Al as additional auxiliary components. This effect could be achieved only when ZnO was combined with Pr, Co, Mg, K, B and Al. Products containing these auxiliary components individually have a very low voltage-dependent nonlinearity (i.e., substantially ohmic) and are not well suited for practical purposes. In the experiment summarized in Table 1, only Pr was used as a rare earth element, but it was found that even when other rare earth elements were used or if two or more rare earth elements were employed, great improvements in the resistance to long wave-tail surge current and service life could be accomplished by the addition of B and Al without sacrificing good nonlinearity. The results of these experiments are shown in Table 2.

The experiment described immediately above was repeated, except that Mg was replaced with Ca or Mg and Ca. The results are shown in Table 3. The results demonstrate that the addition of B and Al was equally effective in improving the resistance to long wave-tail surge current and service life without reducing nonlinearity.

Table 4 shows the results of an experiment wherein K was replaced with Rb and Cs individually, as well as by K and Rb, K and Cs or Rb and Cs. The effect of the addition of B and Al was the same as that when K was used alone.

The results seen from using Ga or In in place of Al are shown in Table 5. Table 5 clearly demonstrates that the effect of adding B and Ga or In was the same as that of adding B and Al.

TABLE 2

| Sample No. | Additives (atm %) Rare earth element (atm %) | Co | Mg | K | Cr | B | Al | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|
| 41 | Tb 1.0 | 1.0 | 0.1 | 0.1 | 0.1 | 0.01 | 0.005 | 227 | 31 | −8.4 | −13.1 |
| 42 | Tb 1.0 | 1.0 | 0.1 | 0.1 | 0.1 | 0.01 | 0.01 | 236 | 33 | −2.2 | −9.5 |
| 43 | Tb 1.0 | 1.0 | 0.1 | 0.1 | 0.1 | 0.01 | 0.05 | 203 | 28 | −1.7 | −6.1 |
| 44 | La 1.0 | 2.0 | 0.1 | 0.1 | 0.1 | 0.01 | 0.005 | 205 | 34 | −7.4 | −8.2 |
| 45 | La 1.0 | 2.0 | 0.1 | 0.1 | 0.1 | 0.01 | 0.01 | 211 | 35 | −4.2 | −9.4 |
| 46 | La 1.0 | 2.0 | 0.1 | 0.1 | 0.1 | 0.01 | 0.05 | 185 | 25 | −2.1 | −7.2 |
| 47 | Nd 1.0 | 5.0 | 0.1 | 0.1 | 0.1 | 0.01 | 0.005 | 212 | 29 | −8.5 | −5.4 |
| 48 | Nd 1.0 | 5.0 | 0.1 | 0.1 | 0.1 | 0.01 | 0.01 | 209 | 30 | −2.1 | −3.6 |
| 49 | Nd 1.0 | 5.0 | 0.1 | 0.1 | 0.1 | 0.01 | 0.05 | 174 | 25 | −1.7 | −2.8 |
| 50 | Sm 1.0 | 5.0 | 0.1 | 0.1 | 0.1 | 0.01 | 0.005 | 185 | 28 | −6.2 | −8.5 |
| 51 | Sm 1.0 | 5.0 | 0.1 | 0.1 | 0.1 | 0.01 | 0.01 | 191 | 30 | −2.1 | −2.1 |
| 52 | Sm 1.0 | 5.0 | 0.1 | 0.1 | 0.1 | 0.01 | 0.05 | 153 | 24 | −1.7 | −3.5 |
| 53 | Dy 1.0 | 1.0 | 0.1 | 0.1 | 0.1 | 0.01 | 0.005 | 197 | 31 | −9.7 | −7.2 |
| 54 | Dy 1.0 | 1.0 | 0.1 | 0.1 | 0.1 | 0.01 | 0.01 | 203 | 34 | −5.2 | −6.8 |
| 55 | Dy 1.0 | 1.0 | 0.1 | 0.1 | 0.1 | 0.01 | 0.05 | 198 | 30 | −5.5 | −8.2 |
| 56 | Pr + La 0.5 + 0.5 | 1.0 | 0.1 | 0.1 | 0.1 | 0.01 | 0.005 | 217 | 32 | −2.8 | −10.1 |
| 57 | Pr + La 0.5 + 0.5 | 1.0 | 0.1 | 0.1 | 0.1 | 0.01 | 0.01 | 210 | 28 | −1.7 | −4.5 |
| 58 | Pr + La 0.5 + 0.5 | 1.0 | 0.1 | 0.1 | 0.1 | 0.01 | 0.05 | 187 | 26 | −4.3 | −6.2 |

TABLE 3

| Sample No. | Additives (atm %) Pr | Co | Mg | Ca | K | Cr | B | Al | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|---|
| 59 | 0.1 | 5.0 | 0 | 0.1 | 0.1 | 0.1 | 0 | 0 | 341 | 33 | −84.1 | −23.1 |
| 60 | 0.1 | 5.0 | 0 | 0.005 | 0.1 | 0.1 | 0.01 | 0.05 | 221 | 35 | −86.3 | −25.2 |
| 61 | 0.1 | 5.0 | 0 | 0.01 | 0.1 | 0.1 | 0.01 | 0.05 | 219 | 34 | −38.1 | −10.1 |
| 62 | 0.1 | 5.0 | 0 | 0.5 | 0.1 | 0.1 | 0.01 | 0.05 | 225 | 31 | −3.7 | −5.4 |
| 63 | 0.1 | 5.0 | 0 | 1.0 | 0.1 | 0.1 | 0.01 | 0.05 | 232 | 30 | −8.9 | −7.2 |
| 64 | 0.1 | 5.0 | 0 | 2.0 | 0.1 | 0.1 | 0.01 | 0.05 | 245 | 37 | −42.1 | −27.2 |
| 65 | 0.1 | 5.0 | 0.1 | 0.1 | 0.1 | 0.1 | 0.01 | 0.05 | 235 | 37 | −5.2 | −9.2 |

TABLE 4

| Sample No. | Additives (atm %) Pr | Co | Mg | K | Rb | Cs | Cr | B | Al | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|---|---|
| 66 | 0.1 | 5.0 | 0.1 | 0 | 0.01 | 0 | 0.1 | 0.01 | 0.005 | 231 | 34 | −5.7 | −10.3 |
| 67 | 0.1 | 5.0 | 0.1 | 0 | 0.1 | 0 | 0.1 | 0.01 | 0.005 | 249 | 37 | −3.2 | −5.2 |
| 68 | 0.1 | 5.0 | 0.1 | 0 | 1.0 | 0 | 0.1 | 0.01 | 0.005 | 312 | 38 | −20.5 | −9.3 |
| 69 | 0.1 | 5.0 | 0.1 | 0 | 0 | 0.01 | 0.1 | 0.01 | 0.005 | 247 | 31 | −10.2 | −6.2 |
| 70 | 0.1 | 5.0 | 0.1 | 0 | 0 | 0.1 | 0.1 | 0.01 | 0.005 | 262 | 35 | −2.7 | −5.4 |
| 71 | 0.1 | 5.0 | 0.1 | 0 | 0 | 1.0 | 0.1 | 0.01 | 0.005 | 316 | 38 | −10.9 | −3.8 |
| 72 | 0.1 | 5.0 | 0.1 | 0.1 | 0.1 | 0 | 0.1 | 0.005 | 0.005 | 265 | 33 | −4.2 | −9.7 |
| 73 | 0.1 | 5.0 | 0.1 | 0.1 | 0.1 | 0 | 0.1 | 0.05 | 0.005 | 196 | 29 | −3.8 | −7.1 |
| 74 | 0.1 | 5.0 | 0.1 | 0.1 | 0.1 | 0 | 0.1 | 0.1 | 0.005 | 97 | 16 | −8.3 | −8.2 |
| 75 | 0.1 | 5.0 | 0.1 | 0.1 | 0.1 | 0 | 0.1 | 0.01 | 0.001 | 281 | 37 | −6.3 | −7.9 |
| 76 | 0.1 | 5.0 | 0.1 | 0.1 | 0.1 | 0 | 0.1 | 0.01 | 0.01 | 272 | 40 | −2.3 | −3.8 |
| 77 | 0.1 | 5.0 | 0.1 | 0.1 | 0.1 | 0 | 0.1 | 0.01 | 0.05 | 203 | 38 | −5.7 | −6.1 |
| 78 | 0.1 | 5.0 | 0.1 | 0.1 | 0 | 0.1 | 0.1 | 0.01 | 0.005 | 251 | 34 | −7.2 | −3.8 |

TABLE 4-continued

| Sample No. | Additives (atm %) Pr | Co | Mg | K | Rb | Cs | Cr | B | Al | $V_1$mA (V) | Non-linearity Index $\alpha$ | Resistance to long wave-tail surge $\Delta V_1$mA (%) | Service life $\Delta V_1\mu A$ (%) |
|---|---|---|---|---|---|---|---|---|---|---|---|---|---|
| 79 | 0.1 | 5.0 | 0.1 | 0 | 0.1 | 0.1 | 0.1 | 0.01 | 0.005 | 268 | 37 | −9.6 | −4.2 |
| 80 | 0.1 | 5.0 | 0.1 | 0.05 | 0.05 | 0.05 | 0.1 | 0.01 | 0.005 | 243 | 33 | −13.1 | −9.3 |

TABLE 5

| Sample No. | Additives (atm %) Element | Atm % | Pr | Co | Mg | K | Cr | B | $V_1$mA (V) | Non-linearity Index $\alpha$ | Resistance to long wave-tail surge $\Delta V_1$mA (%) | Service life $\Delta V_1\mu A$ (%) |
|---|---|---|---|---|---|---|---|---|---|---|---|---|
| 81 | Ga | 0.001 | 0.1 | 5.0 | 0.1 | 0.1 | 0.1 | 0.001 | 236 | 31 | −5.3 | −9.8 |
| 82 | " | 0.005 | 0.1 | 5.0 | 0.1 | 0.1 | 0.1 | 0.001 | 217 | 35 | −3.2 | −4.1 |
| 83 | " | 0.01 | 0.1 | 5.0 | 0.1 | 0.1 | 0.1 | 0.001 | 196 | 37 | −2.9 | −3.8 |
| 84 | " | 0.05 | 0.1 | 5.0 | 0.1 | 0.1 | 0.1 | 0.001 | 151 | 35 | −6.1 | −7.9 |
| 85 | In | 0.001 | 0.1 | 5.0 | 0.1 | 0.1 | 0.1 | 0.001 | 208 | 32 | −7.2 | −10.6 |
| 86 | " | 0.005 | 0.1 | 5.0 | 0.1 | 0.1 | 0.1 | 0.001 | 184 | 38 | −6.1 | −9.2 |
| 87 | " | 0.01 | 0.1 | 5.0 | 0.1 | 0.1 | 0.1 | 0.001 | 143 | 27 | −5.9 | −10.3 |
| 88 | " | 0.05 | 0.1 | 5.0 | 0.1 | 0.1 | 0.1 | 0.001 | 97 | 18 | −13.4 | −15.2 |

As Tables 1 to 5 show, examples of voltage-dependent nonlinear resistors according to the present invention have greatly improved resistance to long wave-tail surge current and appreciably extended service lives while retaining good nonlinearity. Therefore, they are expected to make a very efficient varistor.

EXAMPLE 2

Samples of ZnO powder were mixed thoroughly with $Pr_6O_{11}$, $Co_3O_4$, MgO, $K_2CO_3$, $Cr_2O_3$ and $B_2O_3$ powders in the atomic percents noted in Table 6. Each mix was fired for several hours at between 500° and 1000° C. and ground into adequately small particles. After adding a binder, the particles were shaped into a disk having a diameter of 42 mm and sintered in air for 1 hour at between 1100° and 1400° C. Thirty-seven sintered disks were prepared in this manner. All 37 sintered disks were polished to a thickness of 2 mm and provided with an electrode on each side. As in Example 1, four electrical characteristic parameters were measured; i.e., (1) the interelectrode voltage $V_1$ mA that developed when a current of 1 mA was applied to the device at 25° C.; (2) the nonlinearity index $\alpha$ at 1–10 mA; (3) the resistance to short wave-tail surge current as measured in terms of the change in $V_1$ mA following 2 applications of an impact current of 65 kA for a period of $4\times10^4$ microseconds; and (4) the service life as measured in terms of the change in interelectrode voltage $V_1$ $\mu$A at 1 $\mu$A following the application of 100 mA D.C. for 5 minutes. The results are shown in Table 6. The atomic percents indicated in Table 6 were calculated from the ratio of the number of atoms of a specific additive element to the sum of the number of atoms of the metallic elements present in each mix.

Sample No. 1 in Table 6, which corresponds to a conventional sintered product containing only ZnO, Pr, Co, Mg, K and Cr, had a resistance to short wave-tail surge current of −58.5%, a service life of −32.7% and a nonlinearity index $\alpha$ of 41. Those products having a greater resistance to short wave-tail surge current and a longer service life were Sample Nos. 3 to 6, 9 to 12, 15 to 18, 21 to 23, 26 to 29 and 32 to 37, Sample No. 37 had a low nonlinearity index and was not suitable for practical purposes.

Thus, in order to achieve the intended object of the present invention, Pr, Co, Mg, K, Cr and B must be added in 0.08 to 5.0 atm %, 0.1 to 10 atm %, 0.01 to 5.0 atm %, 0.01 to 1.0 atm %, 0.01 to 1.0 atm % and $5\times10^{-4}$ to $1\times10^{-1}$ atm %, respectively.

As is clear from Table 6, the resistance to short wave-tail surve current and service life of the systems containing Pr, Co, Mg, K and Cr, as auxiliary components were greatly improved by incorporating B as an additional auxiliary component. This effect could be achieved only when ZnO was combined with Pr, Co, Mg, K, Cr and B. Products containing these auxiliary components individually have a very low voltage-dependent nonlinearity (i.e., substantially ohmic) and are not very well suited for practical applications.

In the experiment reported in Table 6, only Pr was used as a rare earth element, but it was found that even when other rare earth elements were used or if two or more rare earth elements were employed, great improvements in the resistance to short wave-tail surge current and service life could be accomplished by the addition of B without sacrificing good nonlinearity. The results of these experiments are shown in Table 7.

The same experiment described immediately above was repeated, except that Mg was replaced by Ca. The results are shown in Table 8. The results of an experiment using Mg and/or Ca and at least one of K, Rb and $C_s$ are shown in Table 9.

TABLE 6

| Sample No. | Additives (atm %) Pr | Co | K | Cr | Mg | B | $V_1mA$ (V) | Non-linearity Index α | Resistance to short wave-tail surge $\Delta V_1mA$ (%) | Service life $\Delta V_1\mu A$ (%) |
|---|---|---|---|---|---|---|---|---|---|---|
| 1 | 0.10 | 5.0 | 0.1 | 0.1 | 0.1 | 0 | 371 | 41 | −58.5 | −32.7 |
| 2 | 0.05 | 5.0 | 0.1 | 0.1 | 0.1 | 0.010 | 261 | 28 | −43.1 | −35.3 |
| 3 | 0.08 | 5.0 | 0.1 | 0.1 | 0.1 | 0.010 | 285 | 32 | −13.4 | −10.2 |
| 4 | 0.10 | 5.0 | 0.1 | 0.1 | 0.1 | 0.010 | 309 | 34 | −3.2 | −5.3 |
| 5 | 0.50 | 5.0 | 0.1 | 0.1 | 0.1 | 0.010 | 334 | 45 | −7.2 | −7.2 |
| 6 | 5.0 | 5.0 | 0.1 | 0.1 | 0.1 | 0.010 | 385 | 40 | −19.6 | −18.4 |
| 7 | 7.0 | 5.0 | 0.1 | 0.1 | 0.1 | 0.010 | 413 | 42 | −29.6 | −38.5 |
| 8 | 0.10 | 0.05 | 0.1 | 0.1 | 0.1 | 0.010 | 251 | 28 | −53.1 | −34.3 |
| 9 | 0.10 | 0.10 | 0.1 | 0.1 | 0.1 | 0.010 | 272 | 34 | −13.1 | −19.7 |
| 10 | 0.10 | 0.50 | 0.1 | 0.1 | 0.1 | 0.010 | 295 | 37 | −4.3 | −2.7 |
| 11 | 0.10 | 1.0 | 0.1 | 0.1 | 0.1 | 0.010 | 302 | 35 | −10.6 | −9.7 |
| 12 | 0.10 | 10.0 | 0.1 | 0.1 | 0.1 | 0.010 | 288 | 38 | −37.2 | −21.5 |
| 13 | 0.10 | 15.0 | 0.1 | 0.1 | 0.1 | 0.010 | 408 | 18 | −62.1 | −33.0 |
| 14 | 0.10 | 5.0 | 0.005 | 0.1 | 0.1 | 0.010 | 264 | 17 | −60.1 | −34.2 |
| 15 | 0.10 | 5.0 | 0.01 | 0.1 | 0.1 | 0.010 | 280 | 28 | −26.1 | −21.3 |
| 16 | 0.10 | 5.0 | 0.05 | 0.1 | 0.1 | 0.010 | 292 | 31 | −13.5 | −10.6 |
| 17 | 0.10 | 5.0 | 0.5 | 0.1 | 0.1 | 0.010 | 359 | 37 | −8.2 | −8.5 |
| 18 | 0.10 | 5.0 | 1.0 | 0.1 | 0.1 | 0.010 | 273 | 38 | −25.2 | −18.7 |
| 19 | 0.10 | 5.0 | 2.0 | 0.1 | 0.1 | 0.010 | 424 | 35 | −30.2 | −35.1 |
| 20 | 0.10 | 5.0 | 0.1 | 0.005 | 0.1 | 0.010 | 442 | 19 | −43.2 | −36.2 |
| 21 | 0.10 | 5.0 | 0.1 | 0.01 | 0.1 | 0.010 | 372 | 27 | −27.5 | −16.4 |
| 22 | 0.10 | 5.0 | 0.1 | 0.2 | 0.1 | 0.010 | 305 | 36 | −2.7 | −8.3 |
| 23 | 0.10 | 5.0 | 0.1 | 1.0 | 0.1 | 0.010 | 284 | 38 | −18.5 | −21.3 |
| 24 | 0.10 | 5.0 | 0.1 | 2.0 | 0.1 | 0.010 | 262 | 33 | −36.3 | −43.2 |
| 25 | 0.10 | 5.0 | 0.1 | 0.1 | 0.005 | 0.010 | 295 | 38 | −42.1 | −33.1 |
| 26 | 0.10 | 5.0 | 0.1 | 0.1 | 0.01 | 0.010 | 302 | 35 | −18.6 | −24.2 |
| 27 | 0.10 | 5.0 | 0.1 | 0.1 | 0.1 | 0.010 | 209 | 34 | −3.4 | −2.7 |
| 28 | 0.10 | 5.0 | 0.1 | 0.1 | 1.0 | 0.010 | 343 | 27 | −9.8 | −6.3 |
| 29 | 0.10 | 5.0 | 0.1 | 0.1 | 3.0 | 0.010 | 369 | 20 | −37.5 | −20.3 |
| 30 | 0.10 | 5.0 | 0.1 | 0.1 | 7.0 | 0.010 | 388 | 15 | −64.1 | −37.2 |
| 31 | 0.10 | 5.0 | 0.1 | 0.1 | 0.1 | 0.0001 | 357 | 38 | −57.8 | −34.2 |
| 32 | 0.10 | 5.0 | 0.1 | 0.1 | 0.1 | 0.0005 | 348 | 40 | −10.1 | −24.2 |
| 33 | 0.10 | 5.0 | 0.1 | 0.1 | 0.1 | 0.0010 | 345 | 43 | −3.7 | −10.3 |
| 34 | 0.10 | 5.0 | 0.1 | 0.1 | 0.1 | 0.0050 | 324 | 38 | −4.2 | −7.2 |
| 35 | 0.10 | 5.0 | 0.1 | 0.1 | 0.1 | 0.0050 | 286 | 29 | −7.6 | −8.5 |
| 36 | 0.10 | 5.0 | 0.1 | 0.1 | 0.1 | 0.10 | 247 | 19 | −13.4 | −28.5 |
| 37 | 0.10 | 5.0 | 0.1 | 0.1 | 0.1 | 0.20 | 198 | 9 | −26.5 | −27.2 |

TABLE 7

| Sample No. | Additives (atm %) Element | Atm % | Co | K | Cr | Mg | B | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|
| 31 | Tb | 1.0 | 1.0 | 0.1 | 0.1 | 0.1 | 0.005 | 371 | 39 | −7.2 | −10.7 |
| 32 | Tb | 1.0 | 1.0 | 0.1 | 0.1 | 0.1 | 0.01 | 347 | 34 | −3.1 | −5.7 |
| 33 | Tb | 1.0 | 1.0 | 0.1 | 0.1 | 0.1 | 0.05 | 165 | 22 | −4.3 | −8.3 |
| 34 | La | 1.0 | 2.0 | 0.1 | 0.1 | 0.1 | 0.005 | 357 | 28 | −8.2 | −9.6 |
| 35 | La | 1.0 | 2.0 | 0.1 | 0.1 | 0.1 | 0.01 | 302 | 25 | −4.2 | −3.7 |
| 36 | La | 1.0 | 2.0 | 0.1 | 0.1 | 0.1 | 0.05 | 169 | 18 | −3.8 | −8.4 |
| 37 | Nd | 1.0 | 5.0 | 0.1 | 0.1 | 0.1 | 0.005 | 355 | 38 | −5.8 | −7.1 |
| 38 | Nd | 1.0 | 5.0 | 0.1 | 0.1 | 0.1 | 0.01 | 308 | 31 | −4.2 | −2.7 |
| 39 | Nd | 1.0 | 5.0 | 0.1 | 0.1 | 0.1 | 0.05 | 147 | 29 | −8.1 | −3.3 |
| 40 | Sm | 1.0 | 5.0 | 0.1 | 0.1 | 0.1 | 0.005 | 361 | 37 | −9.6 | −6.5 |
| 41 | Sm | 1.0 | 5.0 | 0.1 | 0.1 | 0.1 | 0.01 | 317 | 28 | −3.2 | −2.5 |
| 42 | Sm | 1.0 | 5.0 | 0.1 | 0.1 | 0.1 | 0.05 | 208 | 22 | −2.7 | −3.1 |
| 43 | Dy | 1.0 | 1.0 | 0.1 | 0.1 | 0.1 | 0.005 | 348 | 35 | −6.1 | −8.5 |
| 44 | Dy | 1.0 | 1.0 | 0.1 | 0.1 | 0.1 | 0.01 | 284 | 28 | −3.8 | −4.2 |
| 45 | Dy | 1.0 | 1.0 | 0.1 | 0.1 | 0.1 | 0.05 | 241 | 23 | −4.2 | −3.1 |
| 46 | Pr + La | 1.0 | 1.0 | 0.1 | 0.1 | 0.1 | 0.005 | 349 | 33 | −8.3 | −8.9 |
| 47 | Pr + La | 1.0 | 1.0 | 0.1 | 0.1 | 0.1 | 0.01 | 301 | 29 | −2.7 | −2.4 |
| 48 | Pr + La | 1.0 | 1.0 | 0.1 | 0.1 | 0.1 | 0.05 | 247 | 20 | −9.2 | −5.7 |

TABLE 8

| Sample No. | Additives (atm %) Pr | Co | K | Cr | Ca | B | $V_1mA$ (V) | Non-linearity Index $\alpha$ | Resistance to short wave-tail surge $\Delta V_1mA$ (%) | Service life $\Delta V_1\mu A$ (%) |
|---|---|---|---|---|---|---|---|---|---|---|
| 49 | 0.1 | 5.0 | 0.1 | 0.1 | 0.1 | 0 | 364 | 38 | −57.1 | −34.9 |
| 50 | 0.1 | 5.0 | 0.1 | 0.1 | 0.005 | 0.010 | 295 | 37 | −52.5 | −36.5 |
| 51 | 0.1 | 5.0 | 0.1 | 0.1 | 0.01 | 0.010 | 301 | 40 | −27.6 | −18.7 |
| 52 | 0.1 | 5.0 | 0.1 | 0.1 | 0.1 | 0.010 | 307 | 35 | −4.2 | −5.6 |
| 53 | 0.1 | 5.0 | 0.1 | 0.1 | 1.0 | 0.010 | 285 | 23 | −8.4 | −10.7 |
| 54 | 0.1 | 5.0 | 0.1 | 0.1 | 5.0 | 0.010 | 261 | 18 | −26.3 | −22.1 |
| 55 | 0.1 | 5.0 | 0.1 | 0.1 | 7.0 | 0.010 | 247 | 10 | −63.1 | −29.6 |
| 56 | 0.1 | 5.0 | 0.1 | 0.1 | 0.1 | 0.0001 | 347 | 39 | −60.3 | −30.2 |
| 57 | 0.1 | 5.0 | 0.1 | 0.1 | 0.1 | 0.0005 | 338 | 36 | −37.6 | −21.3 |
| 58 | 0.1 | 5.0 | 0.1 | 0.1 | 0.1 | 0.0010 | 340 | 40 | −5.4 | −9.6 |
| 59 | 0.1 | 5.0 | 0.1 | 0.1 | 0.1 | 0.005 | 328 | 38 | −4.2 | −4.7 |
| 60 | 0.1 | 5.0 | 0.1 | 0.1 | 0.1 | 0.05 | 285 | 30 | −6.1 | −8.3 |
| 61 | 0.1 | 5.0 | 0.1 | 0.1 | 0.1 | 0.1 | 236 | 18 | −10.7 | −7.6 |
| 62 | 0.1 | 5.0 | 0.1 | 0.1 | 0.1 | 0.2 | 205 | 8 | −31.5 | −26.4 |

TABLE 9

| Sample No. | Additives (atm %) Pr | Co | K | Rb | Cs | Cr | Mg | Ca | B | $V_1mA$ (V) | Non-linearity Index $\alpha$ | Resistance to long wave-tail surge $\Delta V_1mA$ (%) | Service life $\Delta V_1\mu A$ (%) |
|---|---|---|---|---|---|---|---|---|---|---|---|---|---|
| 63 | 0.1 | 5.0 | 0.1 | 0 | 0 | 0.1 | 0.1 | 0.1 | 0.001 | 357 | 37 | −27.6 | −31.2 |
| 64 | 0.1 | 5.0 | 0.1 | 0 | 0 | 0.1 | 0.1 | 0.1 | 0.05 | 232 | 29 | −13.4 | −19.6 |
| 65 | 0.1 | 5.0 | 0.1 | 0 | 0 | 0.1 | 0.1 | 0.1 | 0.7 | 168 | 21 | −26.3 | −30.3 |
| 66 | 0.1 | 5.0 | 0 | 0.1 | 0.1 | 0 | 0.1 | 0 | 0.01 | 329 | 38 | −4.3 | −8.2 |
| 67 | 0.1 | 5.0 | 0 | 0 | 0 | 0.1 | 0.1 | 0 | 0.01 | 318 | 40 | −3.2 | −10.1 |
| 68 | 0.1 | 5.0 | 0.1 | 0.1 | 0.1 | 0.1 | 0.1 | 0 | 0.01 | 343 | 41 | −5.7 | −9.7 |

In either case, the addition of B was effective in remarkably improving the resistance to short wave-tail surge current and service life without losing high nonlinearity as in the case where Mg or K alone was used.

Therefore, in order to achieve the desired object of the present invention, a rare earth element, Co, Cr and B must be added in 0.08 to 5.0 atm %, 0.1 to 10.0 atm %, 0.01 to 1.0 atm % and $5\times10^{-4}$ to $1\times10^{-1}$ atm %, respectively. Furthermore, at least one of Mg and Ca must be present in 0.01 to 5.0 atm % and at least one of K, Cs and Rb should be present in a total amount of 0.01 to 1.0 atm %. The desired advantage is achieved only when ZnO is combined with a rare earth element, Co, at least one of Mg and Ca, at least one of K, Cs and Rb, as well as Cr and B. Products containing these auxiliary components individually have a very low voltage-dependent nonlinearity (i.e., substantially ohmic) and are not suitable for practical purposes.

As is clear from the foregoing data, the voltage-dependent nonlinear resistor of the present invention which contains ZnO as the primary component and six auxiliary components, i.e., a rare earth element, Co, at least one of Mg and Ca, at least one of K, Cs and Rb, as well as Cr and B has greatly improved resistance to short wave-tail surge current and extended service life without reducing nonlinearity. Therefore, the resistor is expected to make a very efficient varistor.

EXAMPLE 3

Samples of ZnO powder were mixed thoroughly with $Pr_6O_{11}$, $Co_3O_4$, $K_2CO_3$, $Cr_2O_3$, $B_2O_3$ and $Al_2O_3$ powders in the atomic percents listed in Table 10 below. Each mix was fired for several hours at between 500° and 1000° C., and subsequently treated as in Example 1. Thirty-six sintered disks were prepared in this manner and subjected to the measurement of the four electrical characteristic parameters described. The results are shown in Table 10, wherein the atomic percents were calculated from the ratio of the number of atoms of a specific additive element to the sum of the number of atoms of the metallic elements present in each mix.

Sample No. 1 in Table 10 corresponds to a conventional sintered product containing only ZnO, Pr, Co, K and Cr. This product had a resistance to long wave-tail surge current of −79.3%, a service life of −23.5% and a nonlinearity index $\alpha$ of 34. Those products having a greater resistance to long wave-tail surge current and a longer service life were Sample Nos. 3 to 7, 10 to 13, 16 to 19, 22 to 24, 27 to 31 and 33 to 35. Sample No. 31 had a low nonlinearity index and was not suitable for practical purposes.

Thus, in order to achieve the intended object of the present invention, Pr, Co, K, Cr, B and Al has to be added in 0.08 to 5.0 atm %, 0.1 to 10 atm %, 0.01 to 1.0 atm %, 0.01 to 1.0 atm %, $5\times10^{-4}$ to $1\times10^{-1}$ atm % and $1\times10^{-4}$ to $5\times10^{-2}$ atm %.

TABLE 10

| Sample No. | Additives (atm %) Pr | Co | K | Cr | B | Al | $V_1mA$ (V) | Non-linearity Index α | Resistance to short wave-tail surge $\Delta V_1mA$ (%) | Service life $\Delta V_1\mu A$ (%) |
|---|---|---|---|---|---|---|---|---|---|---|
| 1 | 0.10 | 5.0 | 0.1 | 0.1 | 0.0 | 0.0 | 381 | 34 | −79.3 | −23.5 |
| 2 | 0.01 | 5.0 | 0.1 | 0.1 | 0.010 | 0.005 | 221 | 25 | −80.5 | −34.1 |
| 3 | 0.08 | 5.0 | 0.1 | 0.1 | 0.010 | 0.005 | 242 | 28 | −1.4 | −5.7 |
| 4 | 0.10 | 5.0 | 0.1 | 0.1 | 0.010 | 0.005 | 274 | 42 | −1.3 | −1.5 |
| 5 | 0.50 | 5.0 | 0.1 | 0.1 | 0.010 | 0.005 | 305 | 45 | −1.5 | −8.9 |
| 6 | 1.0 | 5.0 | 0.1 | 0.1 | 0.010 | 0.005 | 331 | 38 | −2.3 | −14.1 |
| 7 | 5.0 | 5.0 | 0.1 | 0.1 | 0.010 | 0.005 | 374 | 39 | −23.2 | −20.6 |
| 8 | 7.0 | 5.0 | 0.1 | 0.1 | 0.010 | 0.005 | 410 | 33 | −77.3 | −37.1 |
| 9 | 0.10 | 0.05 | 0.1 | 0.1 | 0.010 | 0.005 | 184 | 19 | −87.3 | −22.5 |
| 10 | 0.10 | 0.10 | 0.1 | 0.1 | 0.010 | 0.005 | 205 | 28 | −34.1 | −13.1 |
| 11 | 0.10 | 0.50 | 0.1 | 0.1 | 0.010 | 0.005 | 221 | 30 | −18.3 | −3.5 |
| 12 | 0.10 | 1.0 | 0.1 | 0.1 | 0.010 | 0.005 | 242 | 33 | −5.7 | −2.1 |
| 13 | 0.10 | 10.0 | 0.1 | 0.1 | 0.010 | 0.005 | 305 | 37 | −38.5 | −10.1 |
| 14 | 0.10 | 15.0 | 0.1 | 0.1 | 0.010 | 0.005 | 347 | 34 | −43.5 | −25.1 |
| 15 | 0.10 | 5.0 | 0.005 | 0.1 | 0.010 | 0.005 | 253 | 35 | −83.1 | −17.4 |
| 16 | 0.10 | 5.0 | 0.01 | 0.1 | 0.010 | 0.005 | 261 | 38 | −24.2 | −8.3 |
| 17 | 0.10 | 5.0 | 0.05 | 0.1 | 0.010 | 0.005 | 268 | 42 | −15.3 | −2.1 |
| 18 | 0.10 | 5.0 | 0.2 | 0.1 | 0.010 | 0.005 | 285 | 40 | −2.5 | −1.5 |
| 19 | 0.10 | 5.0 | 1.0 | 0.1 | 0.010 | 0.005 | 307 | 38 | −8.5 | −8.3 |
| 20 | 0.10 | 5.0 | 2.0 | 0.1 | 0.010 | 0.005 | 341 | 34 | −76.2 | −27.9 |
| 21 | 0.10 | 5.0 | 0.1 | 0.005 | 0.010 | 0.005 | 352 | 38 | −75.1 | −30.4 |
| 22 | 0.10 | 5.0 | 0.1 | 0.01 | 0.010 | 0.005 | 334 | 41 | −5.2 | −17.1 |
| 23 | 0.10 | 5.0 | 0.1 | 0.5 | 0.010 | 0.005 | 262 | 37 | −6.3 | −9.4 |
| 24 | 0.10 | 5.0 | 0.1 | 1.0 | 0.010 | 0.005 | 253 | 34 | −8.5 | −23.8 |
| 25 | 0.10 | 5.0 | 0.1 | 2.0 | 0.010 | 0.005 | 241 | 35 | −81.8 | −37.5 |
| 26 | 0.10 | 5.0 | 0.10 | 0.10 | 0.0001 | 0.005 | 344 | 38 | −83.1 | −27.6 |
| 27 | 0.10 | 5.0 | 0.10 | 0.10 | 0.0005 | 0.005 | 340 | 35 | −25.3 | −12.1 |
| 28 | 0.10 | 5.0 | 0.10 | 0.10 | 0.0010 | 0.005 | 275 | 38 | −3.2 | −5.3 |
| 29 | 0.10 | 5.0 | 0.10 | 0.10 | 0.050 | 0.005 | 189 | 27 | −8.5 | −2.8 |
| 30 | 0.10 | 5.0 | 0.10 | 0.10 | 0.10 | 0.005 | 152 | 25 | −13.1 | −16.5 |
| 31 | 0.10 | 5.0 | 0.10 | 0.10 | 0.50 | 0.005 | 113 | 9 | −24.2 | −18.3 |
| 32 | 0.10 | 5.0 | 0.10 | 0.10 | 0.01 | 0.00001 | 311 | 38 | −87.4 | −20.1 |
| 33 | 0.10 | 5.0 | 0.10 | 0.10 | 0.01 | 0.0001 | 302 | 41 | −27.5 | −16.3 |
| 34 | 0.10 | 5.0 | 0.10 | 0.10 | 0.01 | 0.01 | 242 | 31 | −8.4 | −8.4 |
| 35 | 0.10 | 5.0 | 0.10 | 0.10 | 0.01 | 0.05 | 227 | 27 | −23.2 | −5.1 |
| 36 | 0.10 | 5.0 | 0.10 | 0.10 | 0.01 | 0.1 | 138 | 12 | −79.6 | −16.3 |

As is clear from Table 10, the resistance to long wave-tail surge current and service life of the systems containing Pr, Co, K and Cr as auxiliary components were greatly improved by incorporating B and Al as additional auxiliary components. This effect could be achieved only when ZnO was combined with Pr, Co, K, Cr, B and Al. Products containing these auxiliary components individually have a very low voltage-dependent nonlinearity (i.e., substantially ohmic) and are not highly suitable for practical applications.

In the experiment summarized in Table 10, only Pr was used as a rare earth element, but it was found that even when other rare earth elements were used or if two or more rare earth elements were employed, great improvements in the resistance to long wave-tail surge current and service life could be accomplished by the addition of B and Al without sacrificing good nonlinearity. The results of these are shown in Table 11.

The same experiment described immediately above was repeated, except that K was replaced by Rb or Cs. The results are shown in Table 12. The results using K and Rb, or K, Rb and Cs are shown in Table 13.

TABLE 11

| Sample No. | Additives (atm %) Rare earth element | Atm % | Co | K | Cr | B | Al | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|
| 37 | Tb | 1.0 | 1.0 | 0.1 | 0.1 | 0.010 | 0.005 | 321 | 35 | −7.6 | −13.4 |
| 38 | Tb | 1.0 | 1.0 | 0.1 | 0.1 | 0.010 | 0.01 | 308 | 43 | −4.2 | −5.7 |
| 39 | Tb | 1.0 | 1.0 | 0.1 | 0.1 | 0.010 | 0.05 | 242 | 37 | −5.1 | −8.3 |
| 40 | La | 1.0 | 2.0 | 0.1 | 0.1 | 0.010 | 0.005 | 284 | 38 | −3.8 | −9.6 |
| 41 | La | 1.0 | 2.0 | 0.1 | 0.1 | 0.010 | 0.01 | 271 | 39 | −1.1 | −2.5 |
| 42 | La | 1.0 | 2.0 | 0.1 | 0.1 | 0.010 | 0.05 | 237 | 37 | −8.4 | −3.7 |
| 43 | Nd | 1.0 | 5.0 | 0.1 | 0.1 | 0.010 | 0.005 | 248 | 33 | −7.2 | −8.4 |
| 44 | Nd | 1.0 | 5.0 | 0.1 | 0.1 | 0.010 | 0.01 | 242 | 30 | −3.1 | −5.1 |
| 45 | Nd | 1.0 | 5.0 | 0.1 | 0.1 | 0.010 | 0.05 | 213 | 25 | −3.3 | −6.3 |
| 46 | Sm | 1.0 | 5.0 | 0.1 | 0.1 | 0.010 | 0.005 | 307 | 38 | −6.9 | −9.2 |
| 47 | Sm | 1.0 | 5.0 | 0.1 | 0.1 | 0.010 | 0.01 | 275 | 34 | −4.1 | −5.2 |
| 48 | Sm | 1.0 | 5.0 | 0.1 | 0.1 | 0.010 | 0.05 | 243 | 27 | −2.3 | −7.2 |
| 49 | Dy | 1.0 | 1.0 | 0.1 | 0.1 | 0.010 | 0.005 | 353 | 36 | −5.8 | −5.3 |
| 50 | Dy | 1.0 | 1.0 | 0.1 | 0.1 | 0.010 | 0.01 | 329 | 38 | −4.1 | −8.4 |

TABLE 11-continued

| Sample No. | Additives (atm %) Rare earth element | Atm % | Co | K | Cr | B | Al | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|
| 51 | Dy | 1.0 | 1.0 | 0.1 | 0.1 | 0.010 | 0.05 | 282 | 31 | −8.5 | −3.2 |
| 52 | Pr + La | 0.5 + 0.5 | 1.0 | 0.1 | 0.1 | 0.010 | 0.005 | 352 | 41 | −7.2 | −6.1 |
| 53 | Pr + La | 0.5 + 0.5 | 1.0 | 0.1 | 0.1 | 0.010 | 0.01 | 372 | 43 | −3.1 | −1.8 |
| 54 | Pr + La | 0.5 + 0.5 | 1.0 | 0.1 | 0.1 | 0.010 | 0.05 | 328 | 38 | −2.9 | −3.2 |

TABLE 12

| Sample No. | Additives (atm %) Alkali element | Atm % | Pr | Co | Cr | B | Al | $V_1mA$ (V) | Non-linearity Index α | Resistance to long wave-tail surge $\Delta V_1mA$ (%) | Service life $\Delta V_1\mu A$ (%) |
|---|---|---|---|---|---|---|---|---|---|---|---|
| 55 | Cs | 0.01 | 0.1 | 5.0 | 0.1 | 0.01 | 0.005 | 264 | 33 | −35.1 | −10.6 |
| 56 | Cs | 0.1 | 0.1 | 5.0 | 0.1 | 0.01 | 0.005 | 285 | 38 | −3.5 | −7.2 |
| 57 | Cs | 1.0 | 0.1 | 5.0 | 0.1 | 0.01 | 0.005 | 317 | 41 | −12.3 | −6.3 |
| 58 | Rb | 0.01 | 0.1 | 5.0 | 0.1 | 0.01 | 0.005 | 259 | 34 | −27.5 | −12.1 |
| 59 | Rb | 0.1 | 0.1 | 5.0 | 0.1 | 0.01 | 0.005 | 272 | 31 | −5.4 | −5.1 |
| 60 | Rb | 1.0 | 0.1 | 5.0 | 0.1 | 0.01 | 0.005 | 337 | 41 | −8.3 | −9.2 |

TABLE 13

| Sample No. | Additives (atm %) Pr | Co | K | Rb | Cs | Cr | B | Al | $V_1mA$ (V) | Non-linearity Index α | Resistance to long wave-tail surge $\Delta V_1mA$ (%) | Service life $\Delta V_1mA$ (%) |
|---|---|---|---|---|---|---|---|---|---|---|---|---|
| 61 | 0.1 | 5.0 | 0.1 | 0.1 | 0 | 0.1 | 0.001 | 0.005 | 334 | 38 | −15.3 | −12.3 |
| 62 | 0.1 | 5.0 | 0.1 | 0.1 | 0 | 0.1 | 0.01 | 0.005 | 312 | 39 | −1.7 | −8.2 |
| 63 | 0.1 | 5.0 | 0.1 | 0.1 | 0 | 0.1 | 0.1 | 0.005 | 241 | 31 | −3.2 | −4.3 |
| 64 | 0.1 | 5.0 | 0.1 | 0.1 | 0 | 0.1 | 0.01 | 0.001 | 349 | 43 | −26.3 | −19.2 |
| 65 | 0.1 | 5.0 | 0.1 | 0.1 | 0 | 0.1 | 0.01 | 0.01 | 307 | 39 | −5.7 | −3.1 |
| 66 | 0.1 | 5.0 | 0.1 | 0.1 | 0 | 0.1 | 0.01 | 0.05 | 304 | 34 | −32.5 | −8.3 |
| 67 | 0.1 | 5.0 | 0.1 | 0.1 | 0.1 | 0.1 | 0.001 | 0.05 | 342 | 40 | −26.4 | −9.2 |
| 68 | 0.1 | 5.0 | 0.1 | 0.1 | 0.1 | 0.1 | 0.01 | 0.05 | 308 | 33 | −3.4 | −4.2 |
| 69 | 0.1 | 5.0 | 0.1 | 0.1 | 0.1 | 0.1 | 0.1 | 0.05 | 253 | 29 | −2.1 | −13.5 |
| 70 | 0.1 | 5.0 | 0.1 | 0.1 | 0.1 | 0.1 | 0.01 | 0.001 | 332 | 40 | −16.2 | −16.3 |
| 71 | 0.1 | 5.0 | 0.1 | 0.1 | 0.1 | 0.1 | 0.01 | 0.01 | 301 | 37 | −8.3 | −9.2 |
| 72 | 0.1 | 5.0 | 0.1 | 0.1 | 0.1 | 0.1 | 0.01 | 0.05 | 284 | 30 | −6.1 | −18.3 |
| 73 | 0.1 | 5.0 | 0.1 | 0.1 | 0.1 | 0.1 | 0.001 | 0.05 | 342 | 36 | −13.1 | −10.4 |
| 74 | 0.1 | 5.0 | 0.1 | 0.1 | 0.1 | 0.1 | 0.01 | 0.05 | 331 | 37 | −2.6 | −3.2 |
| 75 | 0.1 | 5.0 | 0.1 | 0.1 | 0.1 | 0.1 | 0.1 | 0.05 | 274 | 35 | −1.7 | −10.9 |
| 76 | 0.1 | 5.0 | 0.1 | 0.1 | 0.1 | 0.1 | 0.01 | 0.001 | 351 | 37 | −9.7 | −10.1 |
| 77 | 0.1 | 5.0 | 0.1 | 0.1 | 0.1 | 0.1 | 0.01 | 0.01 | 303 | 31 | −6.2 | −4.2 |
| 78 | 0.1 | 5.0 | 0.1 | 0.1 | 0.1 | 0.1 | 0.01 | 0.05 | 285 | 28 | −10.1 | −15.3 |

In either case, the addition of B and Al was effective in remarkably improving the resistance to long wave-tail surge current and service life without losing high nonlinearity as in the case where K alone was used.

Thus, in order to achieve the intended object of the present invention, a rare earth element, Co, Cr, B and Al must be added in 0.08 to 5.0 atm %, 0.1 to 10.0 atm %, 0.01 to 1.0 atm %, $5\times10^{-4}$ to $1\times10^{-1}$ atm %, and 0.0001 to 0.05 atm %, respectively. Furthermore, at least one of K, Cs and Rb should be present in a total amount of 0.01 to 1.0 atm %. The desired advantage is achieved only when ZnO is combined with a rare earth element, Co, at least one of K, Cs and Rb, as well as Cr, B and Al. Products containing these auxiliary components individually have a very low voltage-dependent nonlinearity (i.e., substantially ohmic) and are not suitable for practical purposes. When Al was replaced by Ga or In, the results were the same as those summarized in Table 10–13.

As is clear from the foregoing data, the voltage-dependent nonlinear resistor of the present invention which contains ZnO as the primary component and six auxiliary components, i.e., a rare earth element, Co, at least one of K, Cs and Rb, Cr, B, and at least one of Al, Ga and In has greatly improved resistance to long wave-tail surge current and an extended service life without reducing nonlinearity. Therefore, the resistor is expected to make a very efficient varistor.

While the invention has been described in detail and with respect to various embodiments thereof, it is apparent that various changes and modifications may be made therein without departing from the spirit and scope thereof.

We claim:

1. A voltage-dependent nonlinear resistor containing ZnO as the primary component and auxiliary components wherein said auxiliary components comprise: (1) at least one of rare earth elements; (2) Co; (3) at least one of Mg and Ca; (4) at least one of K, Rb and Cs; (5) Cr and (6) B.

2. A voltage-dependent nonlinear resistor as in claim 1, wherein said auxiliary components additionally comprise at least one of Al, Ga and In.

3. A voltage-dependent nonlinear resistor as in claim 2, wherein said at least one of rare earth elements is present in an amount of 0.08 to 5.0 atm %, said Co is present in an amount of 0.1 to 10 atm %, said at least one of Mg and Ca is present in an amount of 0.01 to 5.0 atm %, said at least one of K, Cs and Rb is present in an amount of 0.01 to 1.0 atm %, said Cr is present in an amount of 0.01 to 1.0 atm %, said B is present in an amount of $5\times10^{-4}$ to $1\times10^{-1}$ atm % and said at least one of Al, Ga and In is present in an amount of $1\times10^{-4}$ to $5\times10^{-2}$ atm %.

4. A voltage-dependent nonlinear resistor as in claim 1, wherein said at least one of rare earth elements is present in an amount of 0.08 to 5.0 atm %, said Co is present in an amount of 0.1 to 10.0 atm %, said at least one of Mg and Ca is present in an amount of 0.01 to 5.0 atm %, said at least one of K, Cs and Rb is present in an amount of 0.01 to 1.0 atm %, said Cr is present in an amount of 0.01 to 1.0 atm % and said B is present in an amount of $5\times10^{-4}$ to $1\times10^{-1}$ atm %.

5. A voltage-dependent nonlinear resistor containing ZnO as the primary component and auxiliary components wherein said auxiliary components comprise: (1) at least one of rare earth elements; (2) Co; (3) at least one of K, Cs and Rb; (4) Cr; and (5) B.

6. A voltage-dependent nonlinear resistor as in claim 5, wherein said auxiliary components additionally comprise at least one of Al, Ga and In.

7. A voltage-dependent nonlinear resistor as in claim 6, wherein said at least one or rare earth elements is present in an amount of 0.08 to 5.0 atm %, said Co is present in an amount of 0.01 to 10 atm %, said at least one of K, Cs and Rb is present in an amount of 0.01 to 1.0 atm %, said Cr is present in an amount of 0.01 to 1.0 atm %, said B is present in an amount of $5\times10^{-4}$ to $1\times10^{-1}$ atm % and said at least one of Al, Ga and In is present in an amount of $1\times10^{-4}$ to $5\times10^{-2}$ atm %.

* * * * *